United States Patent [19]

Weber et al.

[11] 4,443,249

[45] Apr. 17, 1984

[54] PRODUCTION OF MECHANICALLY ALLOYED POWDER

[75] Inventors: John H. Weber, Sloatsburg; Paul S. Gilman, Pomona, both of N.Y.

[73] Assignee: Huntington Alloys Inc., Huntington, W. Va.

[21] Appl. No.: 354,884

[22] Filed: Mar. 4, 1982

[51] Int. Cl.[3] ..... B22F 9/04

[52] U.S. Cl. ..... 75/0.5 R; 148/11.5 P

[58] Field of Search ..... 75/0.5 R, 0.5 B, 0.5 BA, 75/0.5 BB, 0.5 BC; 148/11.5 P

[56] References Cited

U.S. PATENT DOCUMENTS

| | | | |
|---|---|---|---|
| 2,853,767 | 9/1958 | Burkhammer | 29/182 |
| 2,995,780 | 8/1961 | West et al. | 18/48 |
| 3,591,362 | 7/1971 | Benjamin | 75/0.5 BA |
| 3,723,092 | 3/1973 | Benjamin | 75/0.5 R |
| 3,728,088 | 4/1973 | Benjamin | 29/182.5 |
| 3,749,612 | 7/1973 | Benjamin et al. | 148/11.5 F |
| 3,785,801 | 1/1974 | Benjamin | 75/0.5 BC |
| 3,874,938 | 4/1975 | Benjamin et al. | 148/32 |
| 3,992,161 | 11/1976 | Cairns et al. | 29/182.5 |

OTHER PUBLICATIONS

A. Arias, "Production of Chromium Base Alloys by Ball Milling in Hydrogen Iodide", Metallurgical Transactions B, vol. 6B, pp. 631–640 (Dec. 1975).

J. S. Benjamin, "Mechanical Alloying", Scientific American, vol. 234, No. 5, pp. 40–48, (May 1976).

Inco Brochure: "IncoMAP Mechanically Alloyed Products for High Temperatures", insofar as attorney and applicants are aware 1st distributed at IncoMAP Conference May 1981.

*Primary Examiner*—W. Stallard

*Attorney, Agent, or Firm*—Miriam W. Leff; Raymond J. Kenny

[57] ABSTRACT

An improved process is provided for producing mechanically alloyed powders of simple and complex alloy systems. In the improved process, the mechanically alloyed powder is milled to an acceptable processing level in a gravity-dependent ball mill to obtain a powder characterized by a laminate-type microstructure which is substantially optically homogeneous at a magnification of 100×. Such acceptable processing level is reached without processing the powder to a featureless microstructure or to saturation hardness.

29 Claims, 8 Drawing Figures

PRODUCTION OF MECHANICALLY ALLOYED POWDER

TECHNICAL FIELD

This invention relates to processes for improving the mechanical properties of metals. More particularly the invention is concerned with a method for producing mechanically alloyed powder which are more predictably in condition for conversion to a substantially homogeneous consolidated product.

RELATED PRIOR ART

The following patents, which are incorporated herein by reference, are exemplary of issued patents which disclose methods of producing mechanically alloyed composite powders and consolidated products made therefrom: U.S. Pat. Nos. 3,591,362; 3,660,049; 3,723,092; 3,728,088; 3,738,817; 3,740,210; 3,785,801; 3,809,549; 3,737,300; 3,746,581; 3,749,612; 3,816,080; 3,844,847; 3,865,572; 3,814,635; 3,830,435; 3,877,930; 3,912,552; 3,926,568; and 4,134,852.

BACKGROUND OF THE INVENTION

In the aforementioned patents, a method is disclosed for producing composite metal powders comprised of a plurality of constituents mechanically alloyed together such that each of the particles is characterized metallographically by an internal structure in which the starting constituents are mutually interdispersed within each particle. In general, production of such composite particles involves the dry, intensive, high energy milling of powder particles such that the constituents are welded and fractured continuously and repetitively until, in time, the intercomponent spacing of the constituents within the particles can be made very small. When the particles are heated to a diffusion temperature, interdiffusion of the diffusible constituents is effected quite rapidly.

The potential for the use of mechanically alloyed powder is considerable. It affords the possibility of improved properties for known materials and the possibility of alloying materials not possible, for example, by conventional melt techniques. Mechanical alloying has been applied to a wide variety of systems containing, e.g., elemental metals, non-metals, intermetallics, compounds, mixed oxides and combinations thereof. The technique has been used, for example, to enable the production of metal systems in which insoluble nonmetallics such as refractory oxides, carbides, nitrides, silicides, and the like can be uniformly dispersed throughout the metal particle. In addition, it is possible to interdisperse within the particle larger amounts of alloying ingredients, such as chromium, aluminum and titanium, which have a propensity to oxidize easily. This permits production of mechanically alloyed powder particles containing any of the metals normally difficult to alloy with another metal. Still further marked improvements in the mechanically alloyed materials can be obtained by various thermomechanical treatments which have been disclosed. U.S. Pat. Nos. 3,814,635 and 3,746,581, for example, involve methods of processing the powders to obtain stable elongated grain structures.

Notwithstanding the significant achievements in properties that have been obtained by the mechanical alloying technique, research efforts continue in order to improve the mechanical alloying technique and the properties of the alloys made by this technique and to improve the economic feasibility of producing the alloys commercially.

One aspect of this invention involves the processing level of the mechanically alloyed powders, another the window permissible for thermomechanical treatment of such powders. By window, is meant the range of thermomechanical treatment parameters which can be applied to produce material meeting target properties.

As indicated above, a characteristic feature of mechanically alloyed power is the mutual interdispersion of the initial constituents within each particle. In a mechanically alloyed powder, each particle has substantially the same composition as the nominal composition of the alloy. The powder processing level is the extent to which the individual constituents are commingled into composite particles and the extent to which the individual constituents are refined in size. The mechanically alloyed powder can be overprocessed as well as underprocessed. An acceptable processing level is the extent of mechanical alloying required in the powder such that the resultant product meets microstructural, mechanical and physical property requirements of the specific application of the alloy. Underprocessed powders, as defined herein, means that the powder is not readily amenable to a thermomechanically process treatment which will form a clean desirable microstructure and optimum properties. Overprocessed powder is chemically homogeneous, the deformation appearance is uniform, and it can under certain conditions be processed to a clean elongated microstructure. However, the conditions under which the material can be processed to suitable properties—i.e. the thermomechanical processing window—is narrower. It will be obvious to those skilled in the art that for commercial processing of alloys standardized conditions are required for thermomechanical processing. Therefore, the size of the window for processing to target properties is very important. Furthermore, since the properties of the material are determined only after consolidation and thermomechanical processing, both the processing level in the powder and the window for thermomechanical processing are very important elements in making the production of mechanically alloyed materials commercially feasible from an economic standpoint.

Typical measures of processing level are powder hardness and powder microstructure. Saturation hardness is the asymptotic hardness level achieved in the mechanically alloyed powder after extended processing. Saturation hardness is actually a hardness range rather than an absolute value. In other words, it is a hardness regime that no longer shows a sharp increase with additional processing. Overprocessed powder is well into the saturation hardness region. It is not necessary to reach saturation hardness level in order to achieve mechanically alloying. The significance of saturation hardness resides in its relationship to the setting up of standardized conditions to thermomechanically treat compacted powders in order to achieve target properties, e.g. of strength and/or microstructure.

With respect to microstructure of the powder, the powder can be processed to a level where, for example, at a magnification of 100×, it is substantially homogeneous chemically, or further until it is "featureless". Featureless, mechanically alloyed powder has been processed sufficiently so that substantially all the particles have essentially no clearly resolvable details optically when metallographically prepared, e.g. differentially etched, and viewed at a magnification of 100×. That is, in featureless particles distinctions cannot be made in the chemistry, the amounts of deformation, or the history of the constituents. As in the case of saturation hardness, the term featureless is not absolute. There are degrees of "featurelessness" and a range within which a powder can be considered optically featureless at a given magnification.

Dry, intensive, high energy milling required to produce mechanical alloying is not restricted to any type of apparatus. Heretofore, however, the principal method of producing mechanically alloyed powders has been in attritors. An attritor is a high energy ball mill in which the charge media are agitated by an impeller located in the media. In the attritor the ball motion is imparted by action of the impeller. Other types of mills in which high intensity milling can be carried out are "gravity-dependent" type ball mills, which are rotating mills in which the axis of rotation of the shell of the apparatus is coincidental with a central axis. The axis of a gravity-dependent type ball mill (GTBM) is typically horizontal but the mill may be inclined even to where the axis approaches a vertical level. The mill shape is typically circular, but it can be other shapes, for example, conical. Ball motion is imparted by a combination of mill shell rotation and gravity. Typically the GTBM's contain lifters, which on rotation of the shell inhibit sliding of the balls along the mill wall. In the GTBM, ball-powder interaction is dependent on the drop height of the balls.

Early experiments appeared to indicate that, while mechanical alloying could be achieved in a GTBM, such mills were not as satisfactory for producing the mechanically alloyed powder as attritors in that it took a considerably longer time to achieve the same processing level.

Comparative merits of processing powders in a GTBM were based on experience with attrited powders. While mechanical alloying can be achieved without processing to saturation hardness, in work on consolidated attrited powder it was found that the powder had to be processed to essentially saturation hardness. It was also found that the attrited powder had to be processed to a substantially featureless microstructure as defined herein; i.e., when viewed metallographically at 100× magnification. A failure to carry out the processing in the attritor to this degree increases the chances of producing an ultimate consolidated product which does not meet the target properties. For example, it might be difficult to produce a clean microstructure from underprocessed attrited powder. However, as indicated above, like saturation hardness, the "featureless" appearance of the powders is not an absolute characteristic—rather, it is a range. And, the exact degree into the "featureless" range which must be achieved in order to have an acceptable processing level is not easily determined. On the other hand, it is possible to overprocess the powders and overprocessed powder narrows the window for thermomechanical processing to target properties. With attrited powder—although possible—it has been difficult to standardize thermomechanical processing conditions on a commercial scale for a given alloy, and the determination of whether the acceptable processing level has been achieved for each batch of alloy can only be determined easily after the final step in the processing.

It has now been found that when the processing conditions are properly chosen, the GTBM can be a preferred route to achieve mechanical alloying to an acceptable processing level. It has also been found that when processing powder in a GTBM, it is not necessary to process powder to the same processing level as in the attritor in order for the powder to achieve an acceptable processing level. Also, powder mechanically alloyed in a GTBM reaches an acceptable processing level at lower levels of hardness than necessary in an attritor. Moreover, since the window for thermomechanical treatment is larger, the powders mechanically alloyed in a GTBM lend themselves to more predictable properties for a given such treatment and to greater flexibility in conditions for thermomechanical treatment. Thus, for many purposes, it is more feasible economically to produce commercial quantities of mechanically alloyed powders in a GTBM than in an attritor.

Another advantage resulting from the lower acceptable processing level is that at the acceptable point the level of processing can be more clearly defined for powders produced in a GTBM because the powder exhibits features when viewed microstructurally. Thus, it is easier to discriminate between the different processing levels It is believed that one reason for the improved processing level factor of the GTBM-produced powder may be that the processing level distribution of the powder particles is narrower than for attritor-produced powders.

Although, as described below, the process of the present invention is applicable to the production of a wide variety of mechanically alloyed powder compositions of simple and complex alloy systems, it will be described with reference to nickel-, iron- and copper-base alloy systems, and with particular reference to nickel-base oxide dispersion strengthened superalloys.

BRIEF DESCRIPTION OF THE DRAWINGS

The alloy composition under investigation in all

FIG. 1 is a photomicrograph at 100× magnification of a mechanically alloyed powder processed in an attritor mill to a substantially featureless appearance.

FIG. 2 is a photomicrograph at 100× magnification of a nickel powder mechanically alloyed in a GTBM and sufficiently processed to optical homogeneity.

FIG. 3 is a photomicrograph at 100× magnification of an extruded, hot rolled bar prepared from a mechanically alloyed powder processed in a GTBM to optical homogeneity, then extruded and hot rolled to produce a coarse, elongated microstructure.

FIG. 4 is a photomicrograph of an attrited powder processed to essentially the same optical appearance as that shown in FIG. 2.

FIG. 5 is a photomicrograph at 100× magnification of an extruded, hot rolled bar prepared from the mechanically alloyed attrited powder shown in FIG. 4.

FIG. 6 is a photomicrograph at 100× magnification of an extruded hot rolled bar prepared from an overprocessed mechanically alloyed attrited powder.

FIG. 7 is a graph showing stress-rupture vs. processing time for an alloy prepared in a GTBM in accordance with this invention and hot rolled at various temperatures.

THE INVENTION

The present invention provides a system for controlling the mechanical alloying of at least two solid components carried out dry by high energy milling in a gravity-dependent type ball mill to maximize mill throughput and minimize time to processing to an acceptable processing level, said processing level being suitable for producing a consolidated product with a substantially clean microstructure and having grains which are substantially uniform in size and of a defined shape, comprising continuing the milling until such time when an optical view at 100× of a representative sample of differentially etched particles milled in said gravity-dependent type ball mill would show a predominant percentage of the particles to have a uniform laminate-type structure. The interlaminar distance in such particles would be no greater than about 50 micrometers, and advantageously no greater than about 45 micrometers. It is noted that when the powders are processed in a gravity-dependent type ball mill, the acceptable processing level can be reached without processing the powder to a featureless microstructure or to saturation hardness.

Figure 2:
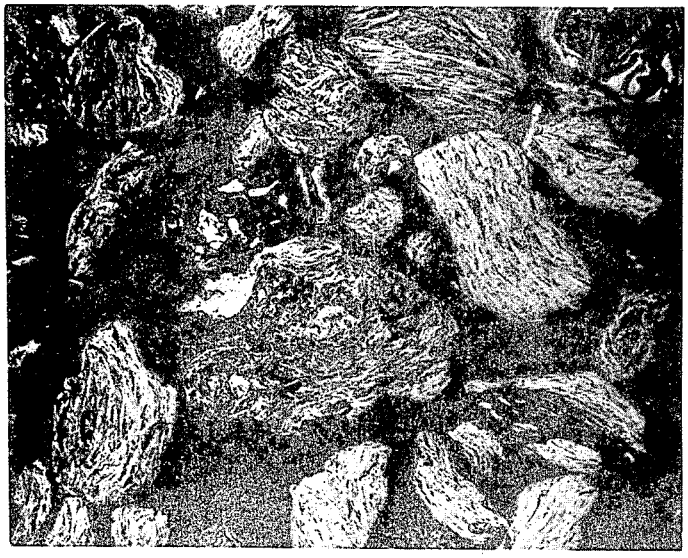

Optically homogeneity as used herein means a substantial number of each of the particles have a uniform structure overall. However, a predominant number, e.g. over 50%, of the particles and even over 75% of the particles have a structure characterized by areas of differentiation, which when etched and viewed at 100× magnification have laminate-type appearance. In some powders the laminae (i.e., areas of differentiation) appear as striations, such as are illustrated in FIG. 2. However, the laminae may form other patterns. In general, the interlaminar distance may vary within the particles, however, the interlaminar spacing of a predominant percentage of powder particles suitably processed in a GTBM should be no greater than about 50 micrometers. The maximum allowable interlaminar spacing is dependent on the alloy being produced and the subsequent thermomechanical processing the powder is to receive in converting the powder to the consolidated product. For example, powder of a simple alloy being processed into a product of small cross-section, e.g. wire, can have an interlaminar spacing approaching a 50 micrometer limit. However, powder of a complex multicomponent alloy to be consolidated directly to a near-net shape would require a smaller interlaminar spacing, e.g., about 5 to 10 micrometers. For a dispersion strengthened alloy powder which is, for example, to be consolidated to produce form through a combined consolidation-deformation (working)-heat treatment sequence the appropriate interlaminar spacing would be about 5 to 15 micrometers. Advantageously, for nickel-base dispersion-strengthened alloys the interlaminar distances should be no greater than about 25 micrometers and average between about 5 and 20 micrometers, e.g. about 15 micrometers.

It is noted that featureless powder particles may be present in the GTBM powder, but do not need to be present. In fact the powder at an acceptable processing level may be substantially all of the laminate-type. In attrited powder, while it is possible that some particles may be present that show the laminar structure when etched and viewed at 100× magnification, a predominant number of the particles must be substantially featureless. Also, as explained above, for attrited powders the thermomechanical treatment to specific properties cannot be easily standardized to accommodate the difference in processing time, as in the case of the GTBM's powder.

The desired grain shape of the consolidated product is related to the alloy composition and use of the consolidated product. For example, for many alloys used for high temperature applications, e.g., 700° C. and above, it is desirable for the consolidated product to have an elongated grain structure. Nickel-, cobalt- and iron-base superalloys are commonly used for such high temperature applications. For copper-base alloys to be used, e.g., for certain conductivity applications, the desired grain structure of the consolidated product is typically equiaxed.

COMPOSITION OF POWDER

The mechanically alloyed powders that can be processed in accordance with the present invention may range from simple binary systems to complex alloy systems. The alloys may or may not include a refractory dispersoid. In general, the alloy systems contain at least one metal, which may be a noble or base metal. The metal may be present in elemental form, as an intermetallic, in a compound or part of a compound. Alloy systems amenable to mechanical alloying techniques are described in detail in the aforementioned U.S. Patents which are incorporated herein by reference. The present embodiments of the invention are described with reference to nickel-base, iron-base, copper-base, and cobalt-base alloys. It is believed that the present invention also applies to aluminum-base alloys. With respect to conventional processing of aluminum powders it is noted that ball-milling in a GTBM-type mill carried out heretofore was carried out merely to reduce the particle size, e.g., to 2 to 3 μm or less, and/or to obtain a flake morphology product. Such processes did not to obtain the internal particle structure characterization of mechanically alloyed powders.

U.S. Pat. No. 3,591,362, for example, refers to more complex alloys that can be produced by mechanical alloying. Examples of the more complex alloys that can be produced by the invention include the well known heat resistant alloys, such as alloys based on nickel-chromium, cobalt-chromium and iron-chromium systems containing one or more of such alloying additions as molybdenum, manganese, tungsten, niobium and/or tantalum, aluminum, titanium, zirconium and the like. The alloying constituents may be added in their elemental form or, to avoid contamination from atmospheric exposure, as master alloy or metal compound additions wherein the more reactive alloying addition is diluted or compounded with a less reactive metal such as nickel, iron, cobalt, etc. Certain of the alloying non-metals, such as carbon, silicon, boron, and the like, may be employed in the powder form or added as master alloys diluted or compounded with less reactive metals. Thus, stating it broadly, rather complex alloys, not limited by considerations imposed by the more conventional melting and casting techniques, can be produced in accordance with the invention over a broad spectrum of compositions and whereby alloys can be produced having melting points exceeding (600° C.), and particularly based on iron, nickel, cobalt, columbium, tungsten, tantalum, copper, molybdenum, chromium or precious metals of the platinum group.

Alternatively, the simple or more complex alloys can be produced with uniform dispersions of hard phases, such as refractory oxides, carbides, nitrides, borides and the like. Refractory compounds which may be included in the powder mix include oxides, carbides, nitrides, borides of such refractory metals as thorium, zirconium, hafnium, titanium, and even such refractory oxides of silicon, aluminum, yttrium, cerium, uranium, magnesim, calcium, beryllium and the like. The refractory oxides generally include the oxides of those metals whose negative free energy of formation of the oxide per gram atom of oxygen at about 25° C. is at least about 90,000 calories and whose melting points is at least about 1300° C. Compositions produced may include hard phases over a broad range so long as a sufficiently ductile component is present to provide a host matrix for the hard phase or dispersoid. Where only dispersion strengthening or wrought compositions are desired, such as in high temperature alloys, the amount of dispersoid may range from a small but effective amount for increased strength, e.g., 0.15% by volume or even less (e.g., 0.1%) up to 25% by volume or more, advantageously from about 0.1% to about 5% or 10% by volume.

The invention is particularly applicable to the production of alloys falling within the following ranges, to wit: alloys containing by weight up to about 65% chromium, e.g., about 5% to 30% chromium, up to about 10% aluminum, e.g., about 0.1% to 9.0% aluminum, up to about 10% titanium, e.g., about 0.1% to 9.0% titanium, up to about 40% molybdenum, up to about 40% tungsten, up to about 30% niobium, up to about 30% tantalum, up to about 2% vanadium, up to about 15% manganese, up to about 2% carbon, up to about 3% silicon, up to about 1% boron, up to about 2% zirconium, up to about 0.5% magnesium and the balance at least one element selected from a group consisting of essentially of iron group metals (iron, nickel, cobalt) and copper with the sum of the iron, nickel, cobalt and copper being at least 25%, with or without dispersion-strengthening constituents such as yttria or alumina, ranging in amounts from about 0.1% to 10% by volume of the total composition.

As stated hereinbefore, the metal systems of limited solubility that can be formulated in accordance with the invention may include copper-iron with the copper ranging from about 1% to 95%; copper-tungsten with the copper ranging from about 5% to 98% and the balance substantially tungsten; chromium-copper with the chromium ranging from about 0.1% to 95% and the balance substantially copper and the like. Where the system of limited solubility is a copper-base material, the second element, e.g., tungsten, chromium and the like, may be employed as dispersion strengtheners.

In producing mechanically alloyed metal particles from the broad range of materials mentioned hereinbefore, the starting particle size of the starting metals may range from about over 1 micrometers up to as high as 1000 micrometers. It is advantageous not to use too fine a particle size, particularly where reactive metals are involved. Therefore, it is preferred that the starting particle size of the metals range from about 3 micrometers up to about 200 micrometers.

The stable refractory compound particles may, on the other hand, be maintained as fine as possible, for example, below 2 micrometers and, more advantageously, below 1 micrometers. A particle size range recognized as being particularly useful in the production of dispersion strengthened systems is 1 nm to 100 nm (0.001 to 0.1 μm).

Examples of specific alloy compositions in weight percent can be found in Table I.

TABLE I

| | NOMINAL COMPOSITIONS - WEIGHT % | | | | | | | | | | |
|---|---|---|---|---|---|---|---|---|---|---|---|
| Element | A | B | C | D | E | F | G | H | I | J | K |
| Chromium | 20 | 15 | 16 | 20 | 15 | 20 | 19.0 | 23.4 | — | 12.5 | 25 |
| Aluminum | 0.4 | 4.5 | 4 | 1.5 | 4.5 | 4.5 | 5.0 | 5.5 | 0.2–1 | 4.7 | — |
| Titanium | 0.4 | 2.5 | 0.5 | 2.5 | 3.0 | 0.5 | 0.3 | 0.48 | — | 2.8 | — |
| Carbon | 0.05 | 0.05 | 0.05 | 0.05 | 0.07 | 0.02 | 0.01 | 0.008 | — | 0.09 | 0.08 |
| Niobium | — | — | — | — | — | — | — | — | — | 1.9 | — |
| Molybdenum | — | 2.0 | — | — | 3.5 | — | — | — | — | 2.5 | — |
| Tungsten | — | 4.0 | — | — | 5.5 | — | — | — | — | — | — |
| Tantalum | — | 2.0 | — | — | 2.5 | — | — | — | — | — | — |
| Boron | — | 0.01 | — | 0.007 | 0.01 | — | — | — | — | 0.01 | — |
| Zirconium | — | 0.15 | — | 0.07 | 0.15 | — | — | — | — | 0.08 | — |
| Vanadium | — | — | — | — | — | — | — | — | — | 0.6 | — |
| Manganese | — | — | — | — | — | — | — | — | — | — | 0.5 |
| Silicon | — | — | — | — | — | — | — | — | — | — | 0.25 |
| Iron | 1 | — | 2 | — | — | Bal | Bal | Bal | 0.1–1 | — | Bal |
| Nickel | Bal | Bal | Bal | Bal | Bal | — | 0.3 | 0.64 | — | Bal | 20 |
| Copper | — | — | — | — | — | — | — | — | Bal | — | — |
| Refractory Dispersoid Oxide (e.g. $Y_2O_3$, $Al_2O_3$, etc.) | 0.6 | 1.1 | 0.6 | 1.3 | 1.1 | 0.5 | 0.5 | 0.41 | 0.4–1.5 | 1.2 | 0.5–2 |

PROCESSING

During processing of the powders in the mill, the chemical constituents including the refractory dispersoids are dispersed in the particles, and the uniformity of the material and the energy content of the material will depend on the processing conditions. In general, important powder processing parameters to obtain the desired powder processing level are the size of the mill, the size of the balls, the ball mass to powder mass ratio, the mill charge volume, the mill speed, the processing atmosphere and processing time. Even the materials of construction of the mills and balls may have a bearing on the end product.

The powders, which may be preblended and/or prealloyed, are charged to a GTBM which typically has a diameter ranging from above 1 foot to about 8 feet (and greater). At or below about 1 foot diameter, the maximum drop height of the balls is such that processing will take too long. Economic factors may mitigate against scale-up of a mill to greater than 8 feet in diameter. The length of the mill may vary from about 1 foot to about 10 feet (and greater) depending on the demand for material. For good mixing in the mill, the length should be less than about 1.5 times the diameter. The lining of the mill is material which during milling should not crush or spall, or otherwise contaminate the powder. An alloy steel would be suitable. The balls charged to the mill are preferably steel, e.g. 52100 steel. The volume of balls charged to mill is typically about 15% up to about 45%, i.e., the balls will occupy about 15 to 45% of the volume of the mill. Preferably, the ball charge to the mill will be about 25 to 40 volume %, e.g. about 35 volume %. Above about 45 volume % the balls will occupy too much of the volume of the mill and this will affect the average drop height of the balls adversely. Below about 15 volume %, the number of collisions is reduced excessively, mill wear will be high and with only a small production of powder. The ratio of mill diameter to initial ball diameter is from about 24 to about 200/1, with about 150/1 recommended for commercial processing. The initial ball diameter may suitably range from about 3/16" to about ¾", and is advantageously about ⅜" to about ¾", e.g. about ½". If the ball diameter is lowered, e.g. below ⅜", the collision energy is too low to get efficient mechanical alloying. If the ball diameter is too large, e.g. above about ¾", the number of collisions per unit time will decrease. As a result, the mechanical alloying rate decreases and a lower uniformity of processing of the powder may also result. Advantageously, balls having an initial diameter of ½" are used in 6' diameter mills. Reference is made to the impace agents as "balls" and in general these agents are spherical. However, they may be any shape. It is understood that the shape of the balls and the size may change in use, and that additional balls may be added during processing, e.g., to maintain the mill charge volume.

The ball mass:powder mass (B/P) ratio in the GTBM is in the range of about 40/1 to about 5/1. A B/P ratio of about 20/1 has been found satisfactory. Above about 40/1 there is more possibility of contamination. Because there tend to be more ball-to-ball collisions, there is a higher rate of ball wear. At the lower ball to powder ratios, e.g. below about 5/1, processing is slow.

The process is carried out advantageously in a GTBM at about 65% to about 85% of the critical rotational speed (Nc) of the mill. The critical rotational speed is the speed at which the balls are pinned to the inner circumferential surface of the GTBM due to centrifugal force. Preferably, the process is carried out at about 70 to 75% Nc. The drop height of the balls is much less effective below about 65% Nc and above about 85% Nc.

Processing is carried out in a controlled atmosphere, depending on the alloy composition. For example, nickel-base alloys are processed in an $O_2$-containing atmosphere, e.g. $O_2$ or air, carried in a carrier gas such as $N_2$ or Ar. An appropriate environment containing free oxygen is, for example, about 0.2% to 4.0% oxygen in $N_2$. Cobalt-base alloys can be processed in an environment similar to that used for nickel-base alloys. For iron-base alloys the controlled atmosphere should be suitably inert. In general, it is non-oxiding, and for some iron-base alloys the nitrogen should be substantially excluded from the atmosphere. Advantageously, an inert atmosphere, for example an argon atmosphere is used. For copper-base alloys the atmosphere is an inert gas such as argon, helium, or nitrogen with small additions of air or oxygen to insure a balance between cold welding and fracture.

The dry, high energy milling is typically carried out in a GTBM as a batch process. The powder is collected, screened to size, consolidated, and the consolidated material is subjected to various thermomechanical processing steps which might include hot and/or cold working steps, and/or heat treatments, aging treatments, grain coarsening, etc.

It is noted that attritors may range in size to a capacity of about 200 lbs. of powder. A GTBM may range in size to those with a capacity for processing up to, for example, about 3000–4000 lbs. in a batch. It will be appreciated that the opportunity afforded by producing arge quantities of mechanically alloyed powders to a readily ascertainable acceptable processing level offers attractive commercial possibilities not possible with presently available attritors.

To afford those skilled in the art a better appreciation of the invention, the following illustrative examples are given.

EXAMPLE 1

Samples of a preblended powder having the nominal composition of Sample A of Table I are charged to a GTBM of 5' dia. by 1' length run at 25.3 rpm. The throughput conditions are shown in Table II. In Table II, the mill volume percent is the percentage of the mill volume occupied by the ball charge (including the space between the balls as a part of the ball volume). The volume of the ball charge is calculated using an apparent density of the balls=4.4 g/cm$^3$. The ball to powder ratio (B/P) is the ratio of the ball mass to powder mass. The ball charge consists of 12.7 mm (½" dia.) burnishing balls. The mill speed is 74% Nc.

Prior to starting a run or restarting a run interrupted for sampling, the mill is purged with $N_2$ for up to 2–3 hours at a rate of 0.23 m$^3$ (10 ft$^3$)$^2$/hr. The dynamic atmosphere during a run is 0.057 m$^3$ (2 ft$^3$)/hr of $N_2$ plus an addition of 0.05% $O_2$ (based on the weight of the heat) per 24 hours.

TABLE II

| Mill Volume (%) | Ball Ball Mass (kg) | 15:1 Powder Mass (kg) | 10:1 Powder Mass (kg) | 7.5:1 Powder Mass (kg) |
|---|---|---|---|---|
| 25 | 612.3 | — | 61.2 | 81.6 |
| 31.5 | 759.3 | — | 75.9 | 101.2 |
| 41.5 | 1016.5 | 67.8 | 101.7 | 135.6 |

All samples are processed for a total of 96 hours. Samples of 5 kg are taken at 48 and 72 hours, and 15 kg at 96 hours for subsequent powder analyses and consolidation by extrusion. In addition, 75 g samples are taken at 24, 36 and 60 hours of processing for particle analysis. Conditions under which various runs are carried out are summarized in Table III.

TABLE III

| GTBM Run No. | Mill Vol. % | B/P | Time hours |
|---|---|---|---|
| 1 | 25 | 10/1 | 48 |
| | | | 72 |
| | | | 96 |
| 2 | 25 | 7.5/1 | 24 |
| | | | 32 |
| | | | 48 |
| | | | 56 |
| | | | 64 |

TABLE III-continued

| GTBM Run No. | Mill Vol. % | B/P | Time hours |
|---|---|---|---|
| | | | 72 |
| | | | 96 |
| 3 | 31.5 | 10/1 | 24 |
| | | | 36 |
| | | | 48 |
| | | | 60 |
| | | | 72 |
| | | | 96 |
| 4 | 31.5 | 7.5/1 | 24 |
| | | | 36 |
| | | | 48 |
| | | | 60 |
| | | | 72 |
| | | | 96 |
| 5 | 41.5 | 15/1 | 24 |
| | | | 36 |
| | | | 48 |
| | | | 60 |
| | | | 72 |
| | | | 96 |
| 6 | 41.5 | 10/1 | 24 |
| | | | 36 |
| | | | 48 |
| 7 | 41.5 | 7.5/1 | 24 |
| | | | 40 |
| | | | 50 |
| | | | 60 |
| | | | 72 |
| | | | 96 |

The −30 mesh powders from each sampling are consolidated under the following thermomechanical conditions: each sample is canned and extruded at a ratio of 6.9/1 at 1066° C. Two additional cans of 96 hour powder from each heat are extruded at 1121° C. and 1177° C. Each extruded bar is cut into four sections for hot rolling at various temperatures. The bars are given a 50% reduction in thickness in two passes. All of the hot rolled bars are given a recrystallization anneal at 1316° C. in air for ½ hour and air cooled.

Longitudinal and transverse specimens are cut from the hot rolled and annealed bar for metallographic preparation. The metallographic samples are etched in 70 ml $H_3PO_4$ and 30 ml distilled $H_2O$.

Figure 3:
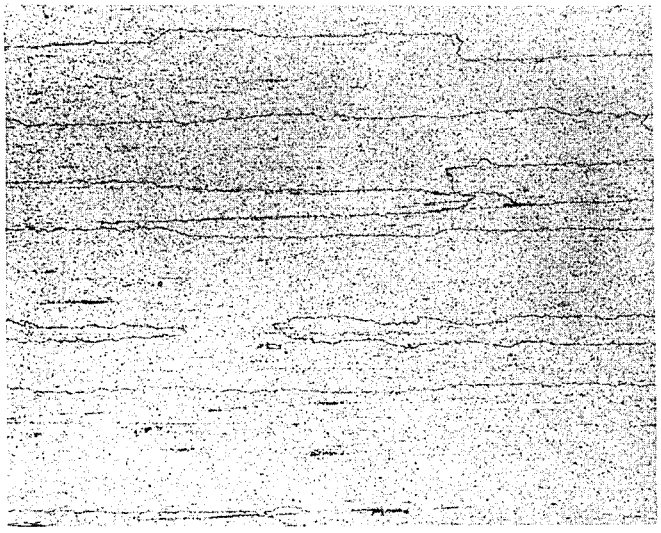

A photomicrograph at 100× of a representative sample of powder processed at 31.5 mill volume percent and at a B/P=10/1 for 48 hours is shown in FIG. 2. The micrograph shows an optically homogeneous microstructure and reveals a laminar structure with an interlaminar distance of less than about 25 micrometers, e.g. about 5 to 15 micrometers. Metallographically examination of the resultant material after thermomechanical processing showed small slightly elongated grains after hot rolling at 788° C. The grains are more elongated after hot rolling at 871° C. FIG. 3, which is a photomicrograph of a sample hot rolled at 1038° C., shows a clean, coarse, elongated microstructure with grains over 1 mm long in the longitudinal direction and 0.1 mm in the transverse direction, and a grain aspect ratio of greater than 10.

Figure 1:
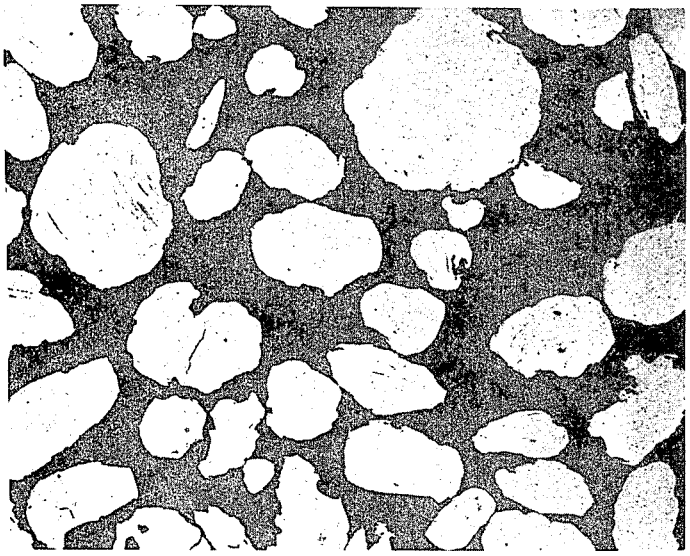
FIGS. 1 through 7 is substantially the same. In the specimens used for FIGS. 2, 3 and 4 the same preblend of powder was used. The material is a dispersion-strengthened nickel-base superalloy, the chemical composition is described in more detail below. The figures are as follows.

The microstructure of FIG. 3 compares favorably with that for the consolidated product of attrited powder which was processed to a substantially featureless microstructure such as shown in FIG. 1 and suitably treated thermomechanically to the consolidated product.

Powder samples from runs shown in Table III examined metallographically, for acceptable processing level in accordance with the present invention, are compared with microstructures of bars formed from the powders.

Representative samples of powder etched in cyanide persulfate and viewed at 100× show the following:

At 60 hours or more under the conditions of all runs in Table III, representative samples of etched powder viewed at 100× appear sufficiently processed in accordance with the present invention.

Powders processed at a mill volume of 31.5% and a B/P ratio of 7.5/1 (Run No. 4) for 24 and 36 hours are not processed to an acceptable level in that the particles do not meet the interlaminar requirements of the present invention and chemical uniformity from particle to particle is not consistent. Run No. 4 powders processed for 48 hours appear to be marginal in that a sufficient number of the interlaminar distances are greater than 25 micrometers to raise a doubt as to whether the acceptable processing level has been reached.

At a constant B/P ratio of 10/1 and a processing time of 48 hours, at 25% and 31.5% mill volume (Run Nos. 1 and 3, respectively) the powders are sufficiently processed at 48 hours. However, at a mill volume of 41.5% (Run No. 6) 48 hours is insufficient.

At a constant mill volume loading, decreasing the B/P ratio increases the processing time.

Examination of micrographs of consolidated material produced under the conditions shown above, confirm the conclusions with regard to observations on processing levels made with respect to the powder samples.

As noted above, the powders reaching the acceptable processing level when viewed metallographically at 100× are laminar, they were not featureless. To obtain a featureless microstructure, under the conditions of this Example, comparable to that shown in FIG. 1 for a commercial attrited powder, the powders in the GTBM must be processed for 96 hours. However, as shown above, it is not necessary to form featureless powders when processing is carried out in a GTBM in order to have sufficiently processed mechanically alloyed powder.

EXAMPLE 2

Figure 4:
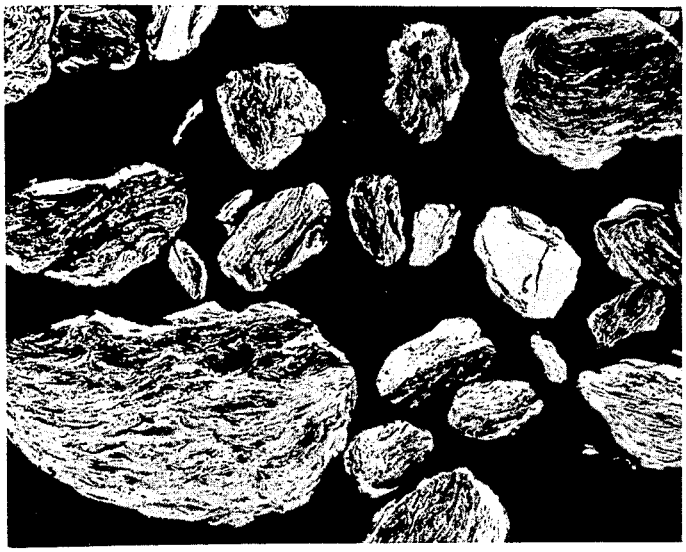
Figure 5:
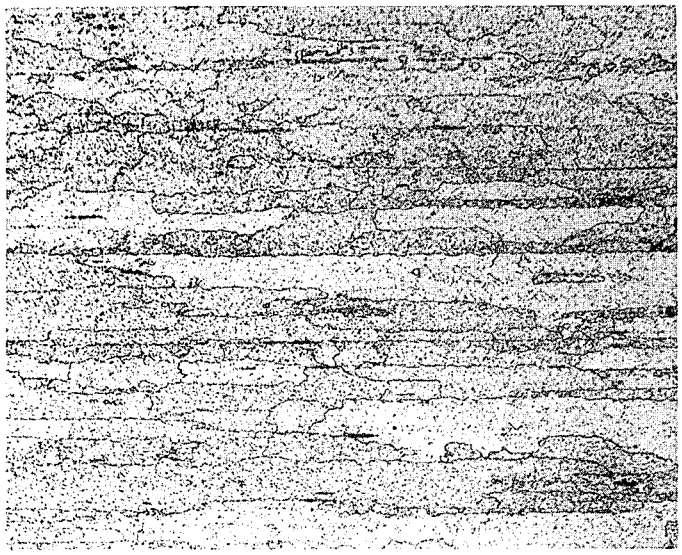
Figure 6:
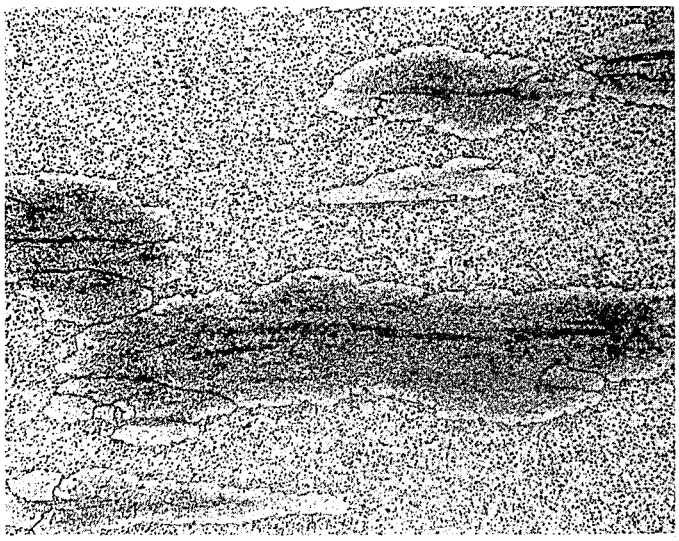

Samples of mechanically alloyed powder having substantially the same composition as the powders in Example 1 are processed in an attritor for 12 hours under conditions which give a powder having the microstructure shown in FIG. 4. FIG. 4 shows that the powder is at substantially the same processing level as the powder shown in FIG. 2, i.e., it is essentially optically homogeneous when viewed metallographically at 100×, but not featureless and it has essentially the same laminar appearance as FIG. 2. A sample of powder processed for 12 hours is consolidated by extrusion at 1066° C. (1950° F.) and then hot rolled at 1038° C. (1900° F.). A photomicrograph at 100× of a resultant bar FIG. 5, shows it is unsuitable. The microstructure is not clean and contains many very fine grains. Photomicrographs of the powder after 24, 36 and 72 show that the powder has reached an essentially featureless microstructure, with fewer and fewer particles showing any laminar structure as the processing continues. Metallographic examination of bar produced from 72-hour powder (FIG. 6) shows a mixed grain structure, indication of a limited thermomechanical window which may be caused by overprocessing.

This example shows that attrited powders must be processed to a processing level beyond that required for powder prepared in a GTBM to have an acceptable processing level. Metallographic examination of bar produced from attrited powders processed for 12, 24, 36 and 72 hours shows that within the range of featureless powder at 100× very subtle differences in the processing level appear to have a marked difference in the microstructure of the hot rolled product.

EXAMPLE 3

Several heats of mechanically alloyed powder are produced in a 5′ dia×1′ long GTBM under the following conditions: B/P=20/1, processing time=36 hours, mill volume %=26%, ball diameter=¾″, mill speed=about 64% $N_c$, atmosphere=nitrogen having 0.1 wt % $O_2$ based on the weight of the heat/24 hours. The mechanically alloyed powder produced has the nominal composition, in weight %: 20 Cr, 0.3 Al, 0.5 Ti, 0.1 C, 1.3 Fe, Bal Ni and contains about 0.6 wt % $Y_2O_3$ dispersoid.

The −20 mesh powder fraction (essentially 96–99% of the processed powder) is canned, extruded at 1066° C., using a total soak time of 21 hours and at an extrusion speed of greater than 10 inches/second. The extruded material is hot rolled in the canned condition at 899° C. to a total reduction in area of 43%. After rolling the canned bar is treated for ½ hour at 1316° C. followed by air cooling.

Tensile properties are determined at room temperature, 760° C. and 1093° C. in the longitudinal and transverse directions, with duplicate tests at each temperature and orientation combination. Stress rupture properties are determined at 760° C. and 1093° C. Tests are performed using a range of stresses to allow for prediction of the strength for failure in 100 hours. Room temperature modulus are also determined. Data obtained are summarized in Table IV and compared with target properties determined for commercial bar made from attrited powder of the same nominal composition.

The data show the strength of the GTBM-product is similar to that of the alloy prepared in an attritor. The only major difference in properties is the long transverse ductility at 1093° C. of the bar prepared from powder processed a GTBM. The cause of this difference was not determined.

With respect to the modulus, it is noted that for certain applications, e.g. turbine vanes, a room temperature modulus is required of less than $25\times10^6$ psi (172.4 GPa). The modulus of the material in accordance with this invention is $21.2\times10^6$ psi (146.2 GPa).

Comparison of the microstructure of the bar produced from powder milled in a GTBM in accordance with this invention with that of an attrited bar of substantially the same preblend composition showed that the coarse elongated grain structure of the ball milled product had a slightly lower grain aspect ratio than the attrited bar.

EXAMPLE 4

Figure 7:
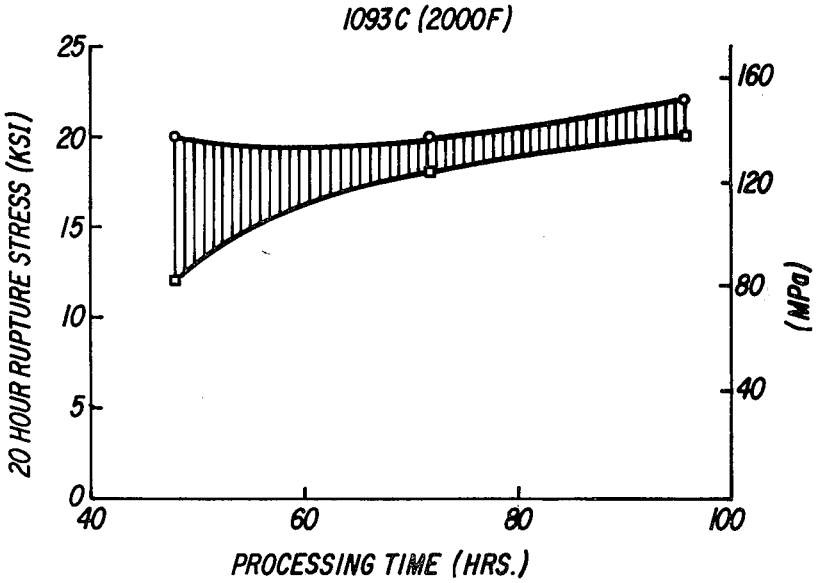

Samples of powder having substantially the same composition as set forth in Example 1 and processed in accordance with the present invention in a GTBM 5 feet in diameter by 1 foot in length at 31.5% mill volume % and 10/1 B/P for 48, 72 and 96 hours. Samples prepared in this manner have optical homogeneity. The samples of powder are extruded at 1066° C. (1950° F.) and hot rolled at various temperatures. The stress ranges for the 20 hour 1093° C. (2000° F.) rupture life as a function of processing time are shown in the cross-hatched area of the graph are summarized in FIG. 7.

The results show that the powder formed in accordance with the invention and processed for a given length of time could be subject to various thermomechanical temperatures to obtain consolidated products with similar stress rupture properties. This is an example of the flexibility in condition for thermomechanical treatment permitted by the powders obtained in accordance with the present invention.

EXAMPLE 5

Figure 8:
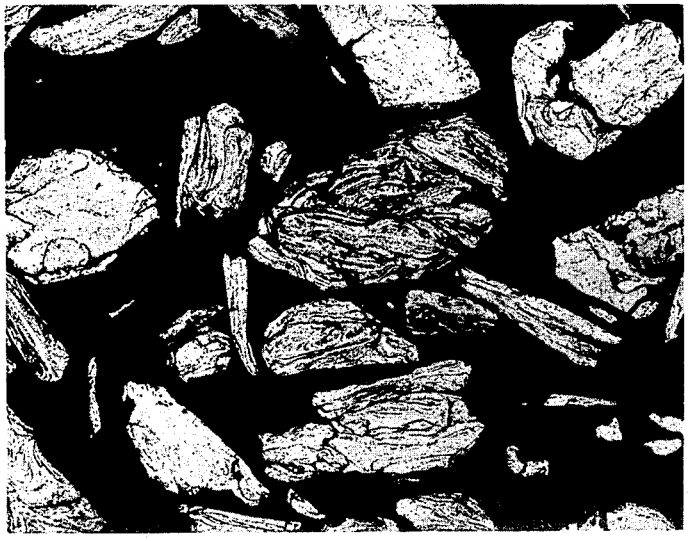
FIG. 8 is a photomicrograph at 100× magnification of dispersion strengthened copper powder mechanically alloyed in a GTBM and sufficiently processed to optical homogeneity.

A copper powder about 75% less than 325 mesh, $H_2$ reduced to remove the oxide surface, is blended with sufficient $Al_2O_3$ to give a product containing 0.66% $Al_2O_3$. The Cu-$Al_2O_3$ blend is processed in a 2-foot diameter by 1 foot length at 35% mill volume, 20/1 B/P for 48 hours. FIG. 8, a photomicrograph at 100× of a sample etched in ammonium persulfate, shows the sample is optically homogeneous in accordance with this invention.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A system for controlling the mechanical alloying of at least two solid particulate components, said mechanical alloying being carried out by dry high energy milling of the particles in a gravity-dependent type ball mill to maximize mill throughput and minimize time to processing of the particles to an acceptable processing level, said processing level being suitable for producing a consolidated product with a substantially clean microstructure and having grains which are substantially uniform in size and of a desired shape, comprising milling the particles to produce a powder product characterized in that an optical view at 100× of a representative sample of differentially etched particles milled in said gravity-dependent type ball mill shows the presence of particles having a uniform laminate-type structure, the remaining particles being substantially featureless, the particles with the laminate-type structure having a maximum interlaminar distance no greater than about 50 micrometers.

2. A system as defined in claim 1, wherein at least a predominant percentage of the particles of the powder product are of the laminate-type.

3. A system as defined in claim 1, wherein the interlaminar distances in such particles of the powder product is no greater than about 45 micrometers.

4. A system as defined in claim 1, wherein the interlaminar distances in such particles of the powder product is no greater than about 25 micrometers and the average intelaminar distance is about 15 micrometers.

5. A system as defined in claim 1, wherein the gravity-dependent ball mill has a diameter of at least above 1 foot.

6. A system as defined in claim 1, wherein the gravity-dependent type ball mill a length of at least about 1 foot.

7. A system as defined in claim 1, wherein length of the gravity-dependent ball mill is less than about 1.5 its diameter.

8. A system as defined in claim 1, wherein the ball charge to the mill is about 15 up to 45 volume %.

9. A system as defined in claim 1, wherein the ratio of mill diameter to initial ball diameter of the ball charge is about 24/1 to about 200/1.

10. A system as defined in claim 1, wherein the initial ball diameter of the ball charge in the mill is about 3/16 to about ¾ inch.

11. A system as defined in claim 1, wherein the ratio of the ball charge to the gravity-dependent type ball mill to the particulate feed charge is about 40/1 to about 5/1 by mass.

12. A system as defined in claim 1, wherein the gravity-dependent type ball mill is operated at about 65% up to about 85% of the critical rotational speed.

13. A system as defined in claim 1, wherein the particles are processed in the mill to a powder product, said powder product being characterized in that a representative sample of the powder has a microstructure at 100× magnification substantially equivalent to that shown in FIG. 2.

14. A system as defined in claim 1, wherein the mechanically alloyed powder product has a composition consisting essentially of, by weight, up to about 65% chromium, up to about 10% aluminum, up to about 10% titanium, up to about 40% molybdenum, up to about 40% tungsten, up to about 30% niobium, up to about 30% tantalum, up to about 2% vanadium, up to about 15% manganese, up to about 2% carbon, up to about 3% silicon, up to about 1% boron, up to about 2% zirconium, up to about 0.5% magnesium, and the balance at least one element selected from the group consisting of iron, nickel, cobalt and copper, with the sum of the iron, nickel, cobalt and copper being at least 25%, and said composition containing up to about 10% by volume of a dispersed refractory compound.

15. A system as defined in claim 14, wherein the mechanically alloyed powder product has a composition based upon a system from the group consisting of nickel-chromium, cobalt-chromium and iron-chromium with at least one alloying additive from the group consisting of molybdenum, tungsten, niobium, tantalum, aluminum, titanium, zirconium, carbon, silcon and boron.

16. A system as defined in claim 14, wherein the refractory compound is selected from the group consisting of refractory oxides, carbides, nitrides and borides.

17. A system as defined in claim 14, wherein the mechanically alloyed powder is a nickel-, cobalt- or copper-base alloy and the controlled atmosphere comprising free $O_2$ in an inert carrier.

18. A system as defined in claim 14, wherein the mechanically alloyed powder product is an iron-base alloy and the controlled atmosphere comprises an inert gas.

19. A system for controlling the mechanical alloying of nickel-, iron-, cobalt- and copper-base alloy systems carried out by dry high energy milling of particles of the component system in a gravity-dependent type ball mill to maximize mill throughput and minimize time to processing to an acceptable processing level, said processing level being suitable for producing a consolidated product with a substantially clean microstructure and having grains which are substantially uniform in size and of a desired shape, comprising milling the particles to produce a powder product characterized in that an optical view at 100× of a representative sample of differentially etched particles milled in said gravity-dependent type ball mill shows the presence of particles having a uniform laminate-type structure, the remaining particles being substantially featureless, and the interlaminar distance is such particles would be an average of about 15 micrometers and no greater than about 25 micrometers.

20. A system for controlling the mechanical alloying of nickel-, cobalt- and iron-base superalloy systems carried out by dry high energy milling of particles of the component system in a gravity-dependent type ball mill to maximize throughput and minimize time to processing to an acceptable processing level, said processing level being suitable for producing a consolidated product with a substantially clean microstructure and having elongated grains, comprising milling the particles to produce a powder product characteized in that an optical view at 100× of a representative sample of differentially etched particles milled in said gravity-dependent type ball mill shows the presence of particles having a uniform laminate-type structure, the remaining particles being substantially featureless, and the interlaminar distance in particles having a laminate-type structure being an average of about 15 micrometers and no greater than about 25 micrometers.

21. A system as defined in claim 1, wherein substantially all of the particles of the powder product are of the laminate-type.

22. A system as defined in claim 19, wherein at least a predominant percentage of the particles are of the powder product of the laminate-type.

23. A system as defined in claim 19, wherein substantially all of the particles of the powder product are of the laminate-type.

24. A system as defined in claim 20, wherein at least a predominant percentage of the particles are of the powder product of the laminate-type.

25. A system as defined in claim 20, wherein substantially all of the particles of the powder product are of the laminate-type.

26. A process for preparing a mechanically alloyed product, said product comprising at least two solid components said product being produced by dry high energy milling of particles, comprising milling of the particles in the gravity-dependent ball mill to produce a powder product characterized in that an optical view at 100× of a representative sample of differentially etched particles milled in said gravity-dependent ball mill shows the presence of particles having a uniform laminate-type structure, the remaining particles being substantially featureless, the particles with a laminate-type structure having a maximum interlaminar distance no greater than about 50 micrometers, whereby the mill throughput is maximized and time for processing to an acceptable level is minimized, said acceptable processing level being suitable for producing a consolidated product with a substantially clean microstructure and having grains which are substantially uniform in size and of a desired shape.

27. A process as defined in claim 26, wherein at least a predominant percentage of the particles of the powder product are of the laminate-type.

28. A process as defined in claim 26, wherein substantially all of the particles of the powder product are of the laminate-type.

29. A process as defined in claim 26, wherein the powder product produced in the gravity-dependent type ball mill is subjected to a heat treatment.

* * * * *